US005746531A

United States Patent [19]

Izhak

[11] Patent Number: 5,746,531

[45] Date of Patent: May 5, 1998

[54] HAIRBUSH AND CONTAINER WITH DISPENSER

[76] Inventor: Allan Izhak, 2 High Point Dr., Poughkeepsie, N.Y. 12603

[21] Appl. No.: 753,709

[22] Filed: Nov. 27, 1996

[51] Int. Cl.[6] ..... A46B 11/00; A46B 11/02

[52] U.S. Cl. ..... 401/139; 132/112; 132/313; 401/137

[58] Field of Search ..... 401/139, 137, 401/262; 132/112, 148, 313; 220/759, 752; 15/194

[56] References Cited

U.S. PATENT DOCUMENTS

| | | | |
|---|---|---|---|
| 550,427 | 11/1895 | Weber | 220/759 X |
| 1,836,102 | 12/1931 | Yutts | 15/194 |
| 1,910,132 | 5/1933 | Silva et al. | 15/194 |
| 2,961,122 | 11/1960 | Smigo | 220/752 |
| 2,998,822 | 9/1961 | Birch et al. | 132/116 |
| 3,085,282 | 4/1963 | Mesick et al. | 132/112 X |
| 3,184,781 | 5/1965 | Hoxie | 15/552 |
| 3,192,555 | 7/1965 | Nyden | 401/262 X |
| 3,363,968 | 1/1968 | Williams | 401/28 |
| 3,544,226 | 12/1970 | Kellis | 401/28 |
| 3,609,050 | 9/1971 | Alexander | 401/190 |
| 3,612,706 | 10/1971 | Verga | 401/190 |
| 3,653,090 | 4/1972 | Weaver | 15/105 |
| 3,856,027 | 12/1974 | Legere | 132/148 |
| 3,868,188 | 2/1975 | Velardi | 401/190 |
| 3,973,853 | 8/1976 | Myers | 401/190 |
| 4,062,635 | 12/1977 | Teh-Sheng | 401/175 |
| 4,252,455 | 2/1981 | de la Pena | 401/190 |
| 4,277,193 | 7/1981 | Knaus | 132/148 X |
| 4,289,153 | 9/1981 | Paccione | 401/137 X |
| 4,399,827 | 8/1983 | Fuhs | 401/129 |
| 4,557,619 | 12/1985 | DeVincentis | 401/190 |
| 4,938,621 | 7/1990 | Pyrozyk | 401/289 |
| 4,955,747 | 9/1990 | Taruer | 401/137 X |
| 5,311,887 | 5/1994 | Ramsey | 132/112 X |
| 5,343,880 | 9/1994 | McKay | 132/112 X |

FOREIGN PATENT DOCUMENTS

| | | | |
|---|---|---|---|
| 63668 | 11/1982 | European Pat. Off. | 401/137 |
| 243572 | 1/1947 | Switzerland | 401/137 |

*Primary Examiner*—Steven A. Bratlie
*Attorney, Agent, or Firm*—Peter S. Canelias

[57] ABSTRACT

A hairbrush incorporated with a container that dispenses sprays, liquids, gels or other dispensable materials. The core of the hairbrush and the base of the container are joined end to end. The container forms the handle of the hairbrush. The top of the container has a closure cap, a cap with snap open lid or a spray nozzle to dispense the contents of the container.

5 Claims, 3 Drawing Sheets

HAIRBUSH AND CONTAINER WITH DISPENSER

BACKGROUND OF THE INVENTION

This invention relates to the field of brushes, particularly hair brushes, which are combined with dispensers of poured or sprayed liquids or creams.

The idea of a combined brush and dispenser has been known for many years. There have been several suggested arrangements for a hair brush combined with a liquid dispenser.

Many patents have been issued to dispense hair care products through the bristles of the brush. For example, U.S. Pat. No. 2,998,822 issued to Birch et al. accomplishes this with an aerosol can mounted to the handle of a brush or a comb. U.S. Pat. No. 3,973,853 issued to Meyers discloses an aerosol can attached to the back of a hair brush with a mechanical linkage for dispensing the material. U.S. Pat. No. 3,544,226 issued to Kellis and U.S. Pat. No. 4,399,827 issued to Fuhs show structures for holding a liquid and applying that liquid through a brush. U.S. Pat. No. 4,557,619 issued to DeVincentis shows a hairbrush and aerosol spray assembly whereby the spray comes out through the bristles of the brush.

Another U.S. Pat. No. 3,856,027 issued to Legue shows a composite structure for holding both an aerosol spray and comb. U.S. Pat. No. 4,938,621 issued to Pyrozyk shows a hairbrush with mousse dispensing device.

Several structures have also been developed to dispense shaving cream, toothpaste, and upholstery shampoo through a brush member. They are shown in U.S. Pat. Nos. 3,184,781; 3,363,968; 3,609,050; 3,612,706; 3,653,090; 3,868,188; 4,062,635; 4,252,455.

Most prior art brushes combined with dispensers employ the use of an aerosol spray container or a non-refillable container which must be disposed of after one use, which is bad for the environment. It would be desirable to have an environmentally correct device, which is economical in that large quantities of sprayable liquids or other personal toilet articles can be purchased and repeatedly used to fill the container assembly, thus cutting down on the disposal of smaller containers of personal toilet articles. Another problem of prior art devices is that the spray has been dispensed through the bristles of the brush which may allow the dispenser to get clogged and the bristles of the brush to become dirty. It would be desirable to have a device which permits hair care products to be dispensed directly from the container assembly and not directly through the brush.

While the prior art includes a substantial number of brushes with dispensers, none have been found that are easy or economical to manufacture, or which can be used in a variety of forms.

Accordingly, one object of the present invention is to provide an improved hairbrush with dispenser which is refillable.

Another object is to provide an improved hairbrush with dispenser which may apply liquid or cream directly to the hair.

Another object is to provide an economical construction of a combined hairbrush and container with dispenser.

SUMMARY OF THE INVENTION

The subject invention is directed to the combination of a hairbrush and container such that the container can function as the handle of the brush and dispense various kinds of dispensable materials, such as liquids, creams or similar materials contained therein.

The brush and container are conjoined end to end. The brush member of the subject assembly includes a plurality of bristles extending radially outward along the length of a brush from a solid core member. One end of the core member of the brush is fixedly mounted to the base or bottom end of the container. A dispenser comprising a spray nozzle assembly or cap is centrally mounted at the top end of the container distal from the core.

The core of the brush can be secured to the container by any of several available means: in one preferred embodiment, the core of the brush is threadably secured to the container, thus, the brush and the container are manufactured with compatible threaded structures. The base of the container preferably has the female thread and the core of the brush has the male thread.

In another embodiment, a screw is employed to secure the container to the brush. A screw and washer are placed inside the container through a hole in the base of the container. The exposed threaded portion of the screw is then inserted through an elastomeric sealing washer and screwed into the core of the brush.

In still another embodiment, the brush core and container assembly can be tooled so they are manufactured in one piece.

In all the embodiments, a cap or spray nozzle which may be interchangeable, is used on the top end of the container to dispense the contents of the container.

DETAILED DESCRIPTION OF THE PREFERRED EMBODIMENTS OF THE INVENTION

Figure 1:
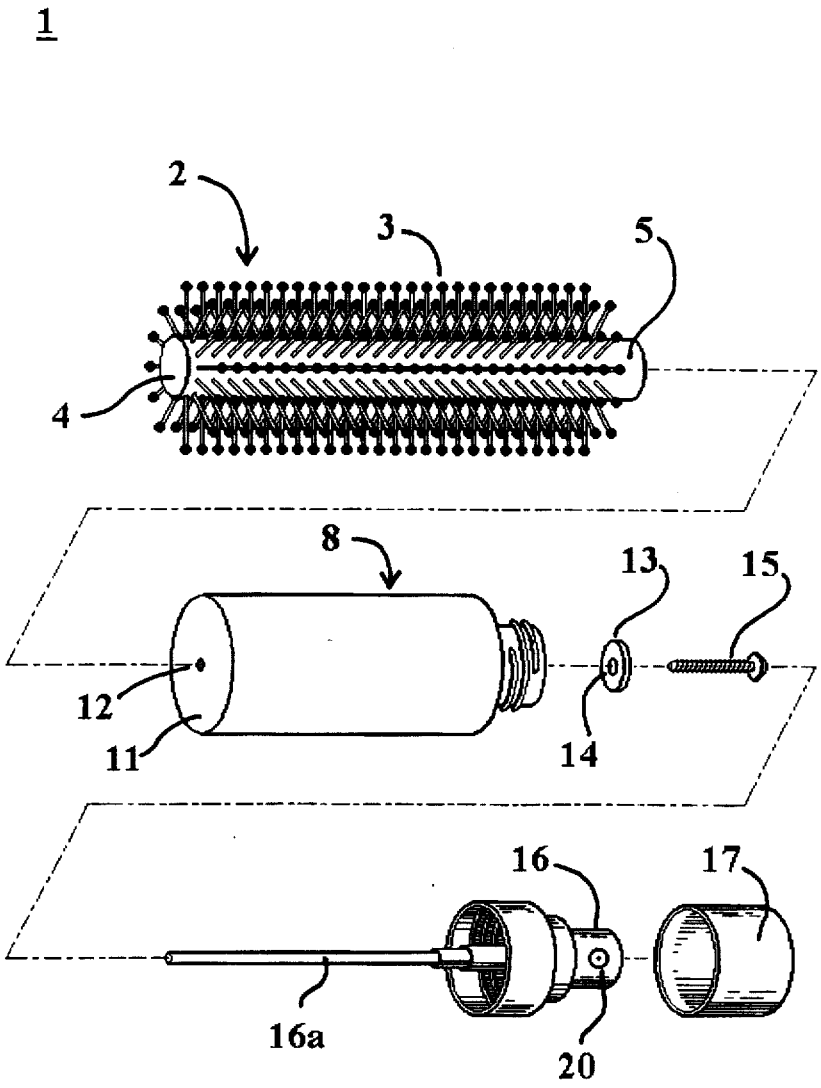
FIG. 1 is an exploded perspective view of the brush and container assembly of the subject invention.

The hairbrush and container assembly of the subject invention is indicated generally by the numeral 1 in FIG. 1. The hairbrush and container assembly includes a hairbrush 2, a container assembly 8, and a dispenser comprising a nozzle assembly 16 with safety cap 17.

The hairbrush 2 includes a solid core 4 from which a plurality of bristles 3 extend radially outward. The bristles 3 extend substantially entirely along the length of core 4. The brush 2 is shown to be circular, but may be of any desired shape, and the bristles need not extend radially.

The hairbrush 2 also includes a base 5 which has a central hole (not shown) of sufficient dimension to enable a screw 15 to pass therethrough as explained further below.

Typically, the entire hairbrush 2 including the bristles 3 are formed from an integral plastic member.

The container assembly 8 includes an elongated hollow body with a wall which preferably is dimensioned to be readily grasped by the user. The container is preferably of plastic material and may be either rigid, or flexible and capable of being squeezed. The container assembly 8 includes a bottom end or base 11. The base 11 is adapted to connect to the brush base 5. Several preferred constructions of mounting means to make this connection are described in the following pages.

As illustrated in FIG. 1 the base 11 of the container assembly 8 has a hole 12 which is disposed centrally within the base. Screw 15 is inserted through a hole 14 of an elastomeric washer 13. The screw 15 and the washer 13 are placed inside the container assembly 8 and inserted through the hole 12 in the base 11 of the container assembly. The remaining portion of the screw 15 that was inserted through the base of the container assembly is inserted through a hole 7 in an elastomeric washer 6. The remainder of the portion of the screw 15 that has been inserted through the washer 13, the base 11 of the container assembly 8, and the elastomeric washer 6 is threaded into the center of the base 5 of the core 4 of hairbrush 2.

The purpose of this embodiment of the subject invention is to conjoin the container assembly to the hairbrush with minimal tooling involved. The container assembly thereby becomes the handle of the hairbrush. The screw holds the container assembly and the brush together while the washers prevent any leakage of fluid.

A dispenser for container 8 comprises a spray nozzle 16. Nozzle 16 is a conventional aerosol spray nozzle with tube **16*a* reaching to the bottom end of container 8 and a manually actuated pump 20 on top. A safety cap 17 guards the pump 20**, when it is not in use.

Figure 2:
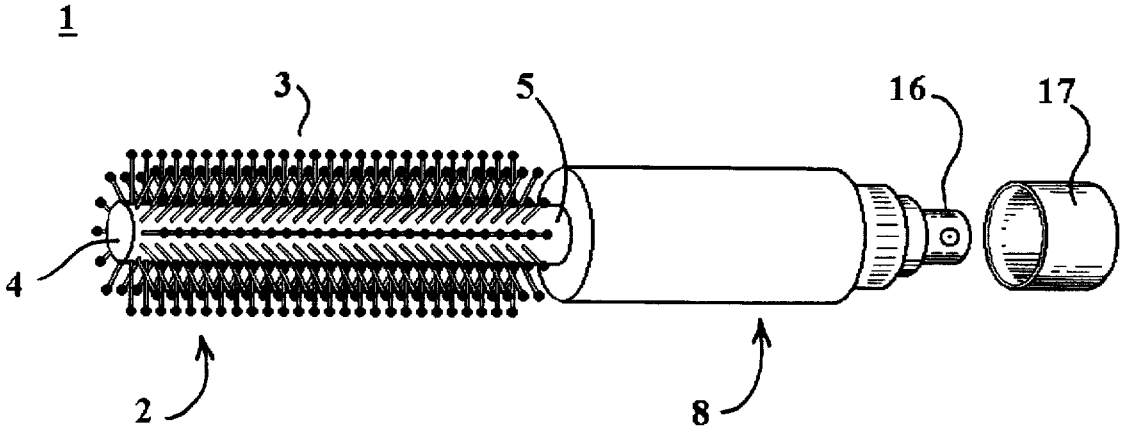
FIG. 2 is a perspective view of the assembled brush and container assembly of FIG. 1.

FIG. 2 shows the assembled subject invention 1 with nozzle dispenser 16 and cap 17 removed for use in dispensing liquid from container 8 in the form of a spray.

Figure 3:
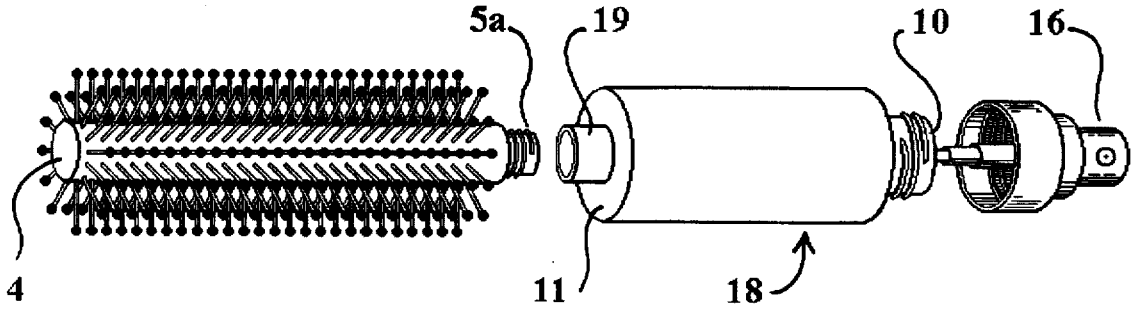
FIG. 3 is an exploded perspective view of the brush and container assembly according to another embodiment.

Turning now to FIG. 3, another embodiment for conjoining the hairbrush and the container assembly is shown. A slightly modified container assembly 18 is thoroughly sealed except for an opening 10 in the top portion of the container assembly which is used for dispensing. The base 11 of the container assembly 18 is adapted to mate with the hairbrush 2. Centrally mounted on the external portion of base 11 of the container assembly is a female threaded coupling 19. The core 4 of the brush 2 is provided with a base **5*a* having a male threaded portion which fits the female threaded coupling 19**.

The purpose of this embodiment of the subject invention is to conjoin the container assembly and the brush by using compatible threaded portions. No leakage of fluid can occur with this embodiment since the container assembly is made with an external coupling on the container assembly. The coupling could also be molded internally in the container wall.

Figure 4:
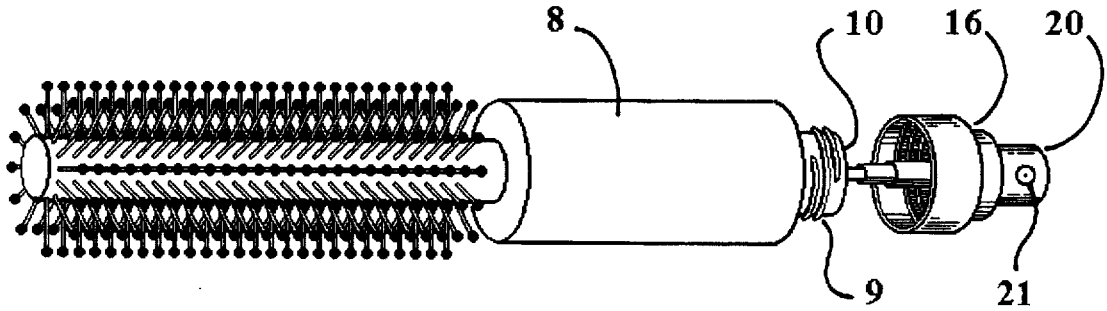
FIGS. 4, 5, and 6 are perspective views of the assembled brush and container previously described, showing three different dispensers for the container assembly.
Figure 5:
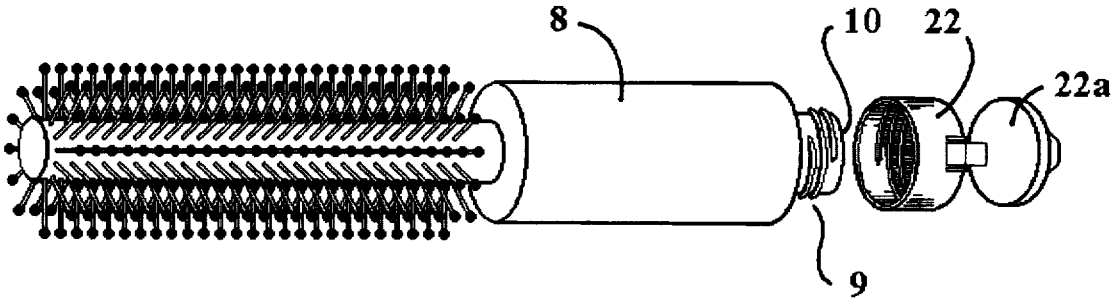
Figure 6:
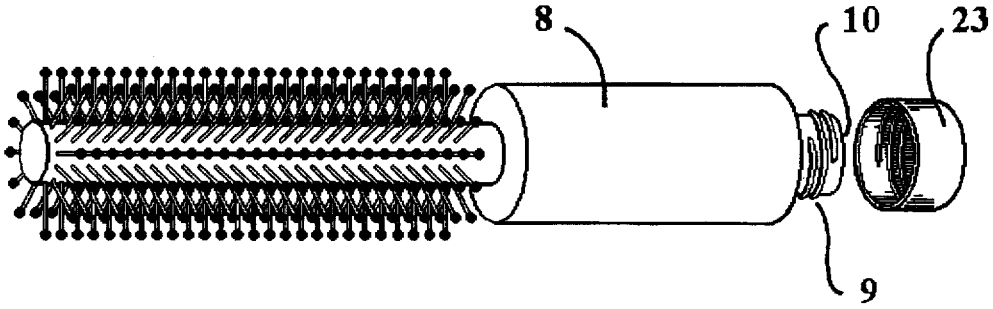

In FIGS. 4, 5 and 6, three different dispensing closures for the opening 10 on the top of the container assembly 8 are shown. The container assembly 18 could also be substituted. In one embodiment shown in FIG. 4, a nozzle spray assembly 16 is adapted to fit the male threaded portion 9 centrally mounted on the top of the container assembly 8. The conventional nozzle spray assembly 16 incorporates the female threaded mate for the male threaded portion 9 of the container assembly. When the pump 20 of the spray nozzle 16 is depressed, a spray emits from the hole 21 in the pump 20 of the spray nozzle 16.

In FIG. 5 another embodiment for the top of the container assembly is shown. The centrally mounted male threaded portion 9 on the container assembly 8 is mated with a female threaded cap 22 with a conventional snap open lid **22*a*. The cap 22 is useful for gels, creams, or dispensable materials requiring pressure on container assembly 8**, which is made of flexible plastic for this purpose.

In FIG. 6 another embodiment for the top of the container assembly is shown. The centrally mounted male threaded portion 9 on the container assembly 8 is arranged to fit a female threaded cap 23, which can be removed to dispense liquid or other contents of container 8. The threaded portions in FIGS. 4, 5 and 6 may be compatible so that the dispensers are interchangeable and can be used with the same container assembly 8.

Figure 7:
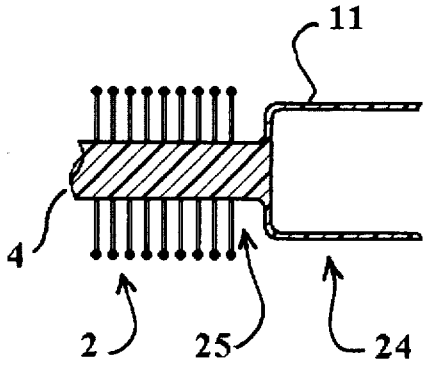
FIG. 7 is an elevation view in cross-section of a transition section between brush and container assembly manufactured as one piece.

FIG. 7 illustrates an alternate construction for joining container assembly 8 to brush 2. The core 4 of the brush is connected to the bottom end 11 of a container assembly 24 by an integral transition section indicated at 25. The transition section is molded as an integral connection between core 4 and the bottom end 11, allowing the brush and container to be manufactured as a single piece.

My improved hairbrush with container assembly is made so that the container is connected end to end with the hairbrush. The contents of the container assembly are readily accessible whenever the hairbrush is used. The improved hairbrush and container assembly is compact, in that the container functions as the handle of the brush. The container assembly is versatile in that it may hold a variety of dispensable materials such as, but not limited to, sprays, liquids, water, shampoo, cream, gel, or even small hard objects such as safety pins, bobby pins or jewelry. The dispenser of the container assembly can be adapted for its contents by utilizing a nozzle spray, cap, or cap with snap on lid, all of which may be interchangeable.

One advantage of my improved hairbrush and container assembly is that whenever you are out of your home you have the advantage of having personal toilet articles or small articles of choice conveniently accessible. During the course of the day hair may develop static electricity and water can be dispensed from the container assembly via the nozzle spray to neutralize the hair so that it can be brushed. Or if one has been at work all day and wants to go out for the evening, favorite gel or hairspray can be easily dispensed from the container and the brush then used to style the hair. In another instance, one may be at the gym and want to wash his or her hair with shampoo dispensed from the container assembly. The combined container assembly and hairbrush will compactly fit into a purse, suitcase or pocket and be used as a hairbrush and dispenser of favorite toilet articles.

While the subject invention has been described and illustrated with respect to certain preferred embodiments, it is obvious that various modifications can be made there in without departing from the spirit of the subject invention which should be limited only by the scope of the appended claims.

What is claimed is:

1. A hairbrush and container assembly comprising:

a brush comprising an elongated core, a plurality of bristles extending generally outward from the core, the core having a solid end portion, the solid end portion having a proximate surface and having a first hole extending through the proximate surface and into the solid end portion, a hollow container formed from a flexible plastic material and having a wall for containing a dispensable material, the wall adapted to serve as a handle for the brush and having opposed top and bottom ends, the bottom end of the container having a second hole therein, mounting and sealing means comprising a screw extending through the second hole into the first hole for connecting the bottom end of the container to the solid end portion of the core through the proximate surface so that a seal is formed between the bottom end of the container and the solid end portion when the screw is securely fastened, a washer disposed on the screw for enhancing the seal between the bottom end of the container and the solid end portion when the screw is securely fastened, preventing leakage of the dispensable material from the container through the second hole, and dispensing means disposed on the top end of the container distal from the core.

2. The hairbrush and container assembly according to claim 1, wherein the dispensing means comprises a spray nozzle assembly.

3. The hairbrush and container assembly according to claim 1, wherein the dispensing means comprises a cap with a snap open lid.

4. The hairbrush and container assembly according to claim 1, wherein the dispensing means comprises a removable closure cap.

5. The hairbrush and container assembly according to claim 1, wherein a second washer, the second washer comprising an elastomeric material, is disposed between the bottom end of the container and the proximate surface of the solid end portion of the core.

* * * * *